United States Patent [19]

Brisken et al.

[11] 4,171,930

[45] Oct. 23, 1979

[54] U-CLIP FOR BOLTLESS BLADE RETAINER

[75] Inventors: Thomas A. Brisken; Robert L. Sponseller; Joseph R. West, all of Cincinnati, Ohio

[73] Assignee: General Electric Company, Cincinnati, Ohio

[21] Appl. No.: 865,290

[22] Filed: Dec. 28, 1977

[51] Int. Cl.[2] ..... F01D 5/30

[52] U.S. Cl. ..... 416/220 R; 416/193 A; 416/500

[58] Field of Search ..... 416/218, 219 R, 219, 416/220 R, 220 A, 221, 193 R, 193 A

[56] References Cited

U.S. PATENT DOCUMENTS

| | | | |
|---|---|---|---|
| 2,985,426 | 5/1961 | Hunter et al. | 416/193 |
| 2,998,959 | 9/1961 | Haworth et al. | 416/193 |
| 3,181,835 | 5/1965 | Davis | 416/145 |

FOREIGN PATENT DOCUMENTS

| | | | |
|---|---|---|---|
| 1401452 | 2/1969 | Fed. Rep. of Germany | 416/345 |

*Primary Examiner*—Everette A. Powell, Jr.
*Assistant Examiner*—A. N. Trausch, III
*Attorney, Agent, or Firm*—Dana F. Bigelow; Derek P. Lawrence

[57] ABSTRACT

Both the disk and the blade retainer have a radially inward extending flange which axially abuts the other. A U-clip ring with its open side disposed radially outward is placed over the two flanges to hold them axially together and means is provided to maintain the U-clip ring in its holding position. In a preferred embodiment, the ring is constructed with its side farthest from the disk having a substantially greater radial height than that of the side closest the disk, and the circumferential length of the U-clip is so sized that there is a relatively small gap between its ends when it is in the installed position. With these features, the ring will remain in its assembled position without any other holding means. Removal can be effected by first radially moving one end of the ring inwardly with respect to the other and then axially moving it until it clears the other end.

15 Claims, 19 Drawing Figures

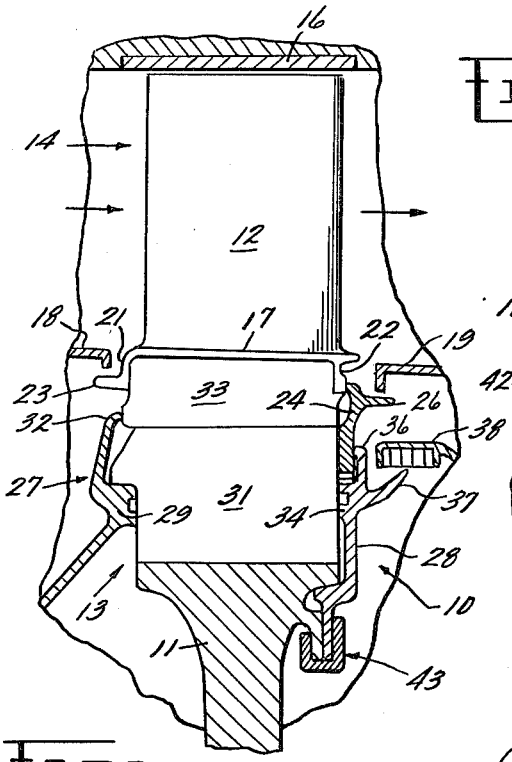
Fig 1
Fig 2
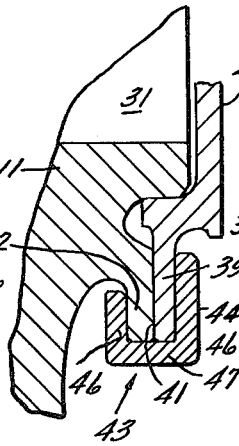
Fig 3
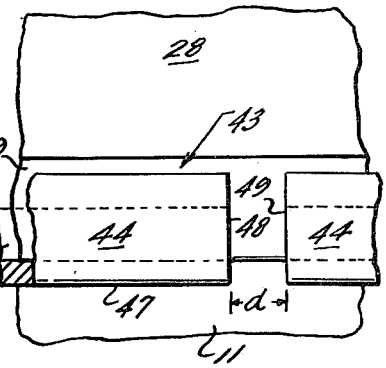
Fig 4
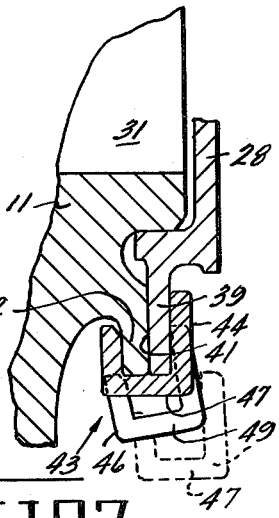
Fig 5
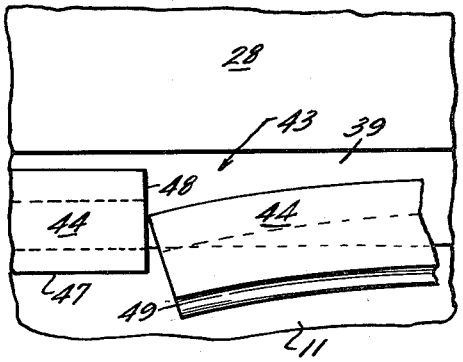
Fig 6
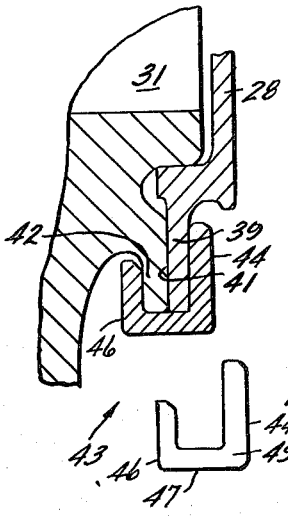
Fig 7
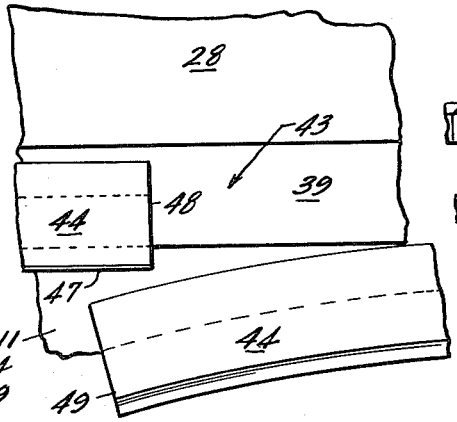
Fig 8
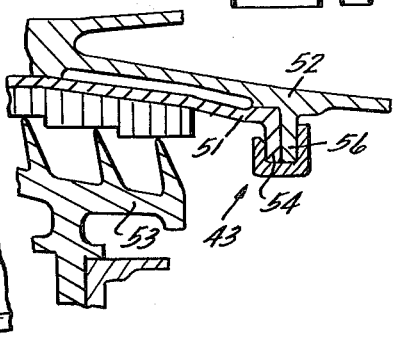

10
13
C.G.

U-CLIP FOR BOLTLESS BLADE RETAINER

The invention herein described was made in the course of or under a contract, or a subcontract thereunder, with the United States Department of the Air Force.

BACKGROUND OF THE INVENTION

This invention relates generally to turbomachines and, more particularly, to retaining means for blades therein.

Retention of aerodynamic blades within the periphery of a turbomachinery rotor or disk has long been a problem in the industry. The most common method of retaining blades within the disk is by the combination of dovetailed blades and axial slots in the periphery of the disk. This method has been found to be quite satisfactory and desirable for purposes of withstanding the radial loads caused by centrifugal force. However, since there are considerable axial forces on the blades, there is a necessity to provide for axial retention thereof in both directions. In this connection, it is desirable to minimize weight, windage and stress concentrations while providing a positive retention means which is simple and relatively easy to assemble and disassemble. That is, for maintainability and repair purposes, it should be relatively easy to remove and replace a single blade which may be damaged by a foreign object or the like.

Historically, axial blade retainers have been secured to the disk by way of a plurality of circumferentially spaced bolts. This approach is undesirable for a number of reasons including increased windage and air temperature caused by the protruding bolt heads or nuts, the existence of stress concentrations at the bolt holes, and the difficulty and time of assembly and disassembly.

In recognition of these problems, a boltless blade retainer was devised as shown and described in U.S. Pat. No. 3,768,924, issued to Robert J. Corsmeier et al and assigned to the assignee of the present invention. Although this approach offers significant improvement in the characteristics mentioned above, the increased demand in the industry for improved cyclic life capabilities calls for further improvements. Since the design loads, operating environment and material capability are all essentially fixed, life improvements must be achieved by streamlining the design and reducing stress concentrations in life limiting areas.

It is therefore an object of the present invention to provide an improved boltless blade retainer.

Another object of the present invention is the provision in a disk and blade retainer combination for improved cyclic life capabilities.

Another object of the present invention is the provision in a blade retainer apparatus for reduced stress concentrations in life limiting areas.

Still another object of the present invention is the provision for a blade retainer apparatus which is easy to assemble and effective in use.

These objects and other features and advantages become more readily apparent upon reference to the following description when taken in conjunction with the appended drawings.

SUMMARY OF THE INVENTION

Briefly, in accordance with one aspect of the invention, the rotor disk is provided on its one side with an inwardly extending flange for close axial engagement with the flange of a retainer ring. A U-clip retainer ring, with its open side disposed radially outward, is placed over the two flanges so as to hold them axially together. Means are then provided to prevent inward radial movement of the U-clip such that it holds the retainer ring in its fixed position.

By another aspect of the invention, the U-clip retainer ring is constructed with its side farthest from the disk being of a greater radial height than that of the side nearest the disk. Further, the circumferential length of the split ring is such that, when it is in the installed position, a relatively small gap exists between the two ends thereof. These two features allow the split ring to be installed in its final holding position with relative ease, and cause the split ring to remain in this position unless it is removed in a specified manner. This removal is effected by first radially deflecting one end of the clip relative to the other, and then deflecting it axially away from the disk to clear the other end of the ring. In this way, the retainer ring may be easily assembled and disassembled, and no other holding means is required.

By yet another aspect of the invention, the U-clip retainer ring is maintained in its holding position by way of a plurality of embossments on the one side of the retainer element. The U-clip then springs open to be installed over the embossments and then springs shut to its final holding position. Removal of the U-clip is effected by forcing the U-clip to spring open and over the embossments.

By still another aspect of the invention, the retainer ring may be maintained in its holding position by inserting a spacer between its two ends and placing a flexible sheet metal clip between a circumferential groove formed in the axially inner side of the spacer and a shallow circumferential groove formed in the retainer element. In this way the metal clip holds the spacer in its radial position, and the spacer holds the ends of the U-clip in their fixed position.

In the drawings as hereinafter described, a preferred embodiment and modified embodiments are depicted; however, various other modifications and alternate constructions can be made thereto without departing from the true spirit and scope of the invention.

BRIEF DESCRIPTION OF THE DRAWINGS

FIG. 1 is a fragmentary axial sectional view of a turbine disk and blade assembly in accordance with the preferred embodiment of the invention;

FIG. 2 is an enlarged view of the retainer ring portion thereof;

FIG. 3 is a fragmentary end view thereof;

FIG. 4 is a sectional view of the retainer ring portion of the invention as shown in the partially disassembled position;

FIG. 5 is a fragmented end view thereof;

FIG. 6 is a cross-sectional view of the retainer ring portion of the invention as shown in a further disassembled position;

FIG. 7 is a fragmented end view thereof;

FIG. 8 is a sectional view of the retainer ring portion of the invention as applied for an alternate purpose;

DESCRIPTION OF THE PREFERRED EMBODIMENT

Figures 9, 10, 11, 12, 13, 14, 15, 16, 17:
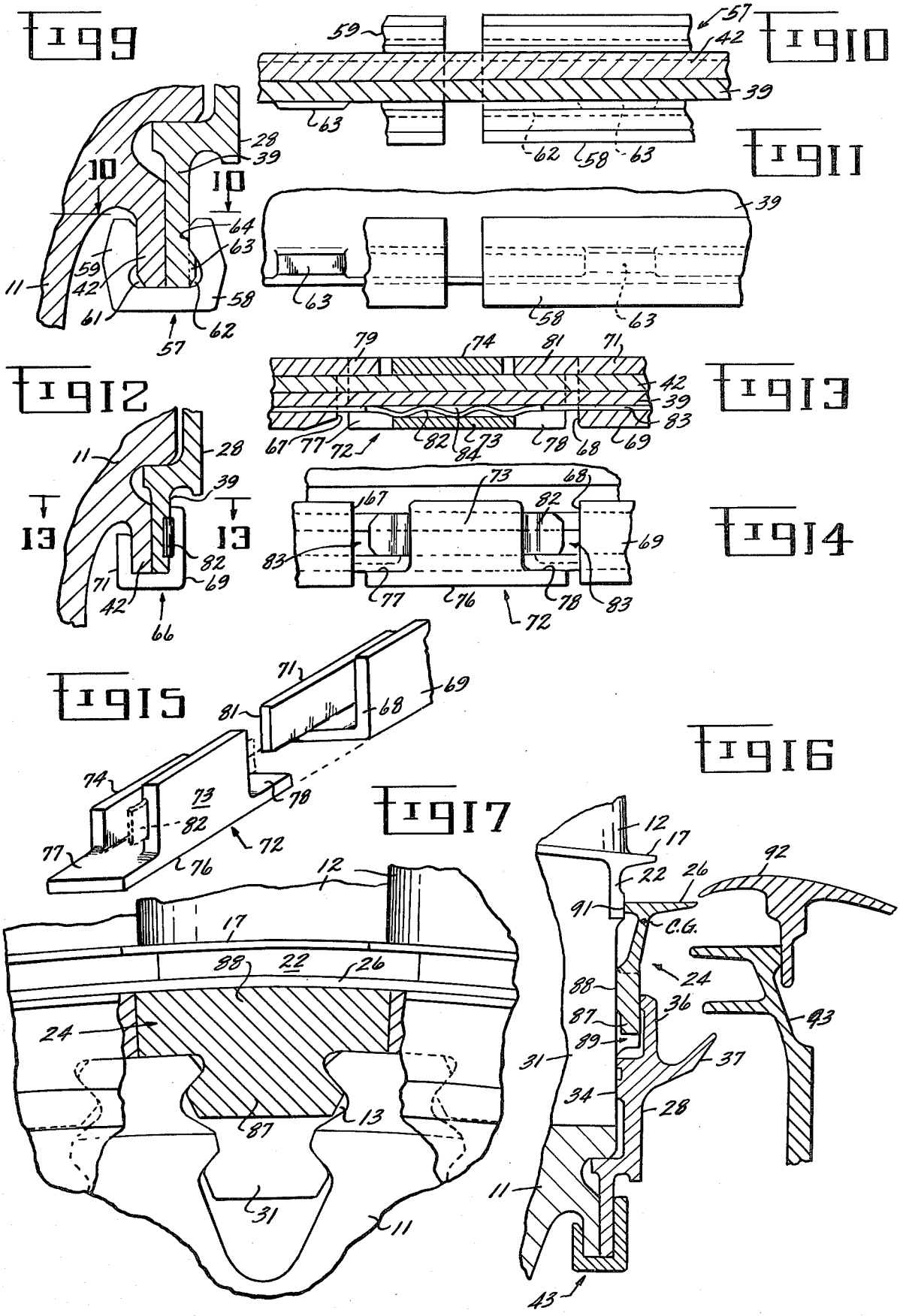
FIG. 9 is an axial cross-sectional view of a modified embodiment of the retainer ring portion of the invention.
FIG. 10 is a partial view thereof as seen along lines 10—10 of FIG. 9.
FIG. 11 is a fragmented end view thereof.
FIG. 12 is an axial cross-sectional view of another embodiment of the retainer ring portion of the invention.
FIG. 13 is a partial view thereof as seen along lines 13—13 of FIG. 12.
FIG. 14 is a fragmented end view thereof.
FIG. 15 is a perspective view of the bridging element thereof.
FIG. 16 is an axial cross-sectional view of the blade retaining and damping apparatus.
FIG. 17 is a fragmented end view thereof with a portion shown in cross-section.

Referring to FIG. 1, the invention is shown generally at 10 as applied to a turbine disk 11 having a plurality of turbine blades 12 secured in axial dovetail slots 13 of the disk. The blades project radially into a flow path 14 which is defined in that plane by a shroud 16 on the outer side and the blade platform 17 on the inner side. Vane platforms 18 and 19 partially define the inner flow path upstream and downstream of the row of blades 12.

Extending radially inward from the blade platform 17 are forward and aft shank rails 21 and 22, respectively. The forward shank rail 21 has a forward-extending flange 23 which is disposed in close relationship with the vane platform 18 for sealing purposes. The aft shank rail 22 has a sealing surface formed on the downstream side thereof which is closely engaged by a seal/damper 24 which acts to dampen vibrations in the blade 12 as will be more fully described hereinafter. In a manner similar to that of the forward shank rail 21, the seal/-damper 24 has a rearwardly extending flange 26 which is disposed in close sealing relationship with the downstream vane platform 19.

Axial retention of the blades 12 in the dovetail slots of the disk 11 is provided by a forward retainer/seal and aft retainer/seal, 27 and 28, respectively. The forward retainer/seal 27 has a retainer portion 29 which forms an axial interference fit with the disk dovetail to prevent forward axial movement of the blade within the dovetail slot. It also includes a damper/seal portion 32 which tightly engages the forward edge of the blade shank 33 to provide damping to the blade and to prevent hot gas exposure on the disk/blade dovetail.

.On the rear side of the disk 11 the aft retainer/seal 28 has a retainer portion 34 which tightly engages the dovetail slot portion of the disk to prevent blade axial movement rearward. It also includes a seal/damper retainer portion 36 which acts to hold the seal/damper in place in a manner to be further described hereinafter. Also included as part of the aft retainer/seal 28 is an aft flange 37 which extends rearwardly and radially outward to engage a stationary seal element 38 for the purpose of sealing the inner cooling airflow from the outer hot gas flow.

Further describing the structure of the aft retainer/-seal 28, and referring to FIG. 2, it comprises a ring which closely hugs the disk rear side and projects radially inward toward the disk to terminate on its radially inner end with an annular flange 39. One face 41 of the flange 39 is disposed in close-fit engagement with a face of an annular flange 42 projecting rearwardly and radially inwardly from the disk 11 as shown in FIG. 2. A U-clip retainer ring 43 having its open side facing radially outward fits over the two flanges 39 and 42 to hold them in tight axial relationship such that the retainer/-seal 28 is held to perform its retainer function. The U-clip retainer ring 43 comprises radially extending outer and inner walls 44 and 46, respectively, interconnected by an axially extending wall 47. It will be recognized that in the preferred embodiment of the invention as shown in FIGS. 1–8, the radial height of the outer wall 44 is substantially greater than the radial height of the inner wall 46. This difference in radial heights can be varied somewhat to accommodate a particular structure to which it is applied, but it is critical to the proper operation of the preferred embodiment of the retainer ring 43 as will be more clearly seen hereinafter. Generally, it can be said that the difference between the radial height of the outer and inner walls is less than one-half the radial height of the outer wall 39. There is, of course, a maximum limit of this difference in radial height which must be determined by consideration of the actual structure to which it is applied and the performance characteristics which are desired. It may be generally said that the difference between the radial heights of the outer and inner walls should be greater than one-fourth the radial height of the outer wall 39.

As can be seen in FIG. 3, there exits a gap having a dimension d between the two ends 48 and 49 of the retainer ring 43. Again, in accordance with the preferred embodiment of the invention, the circumferential length of the retainer ring 43 is such that when the ring is placed in its installed position as shown in FIG. 3, the length d of the gap between the two ends is such that the U-clip ring 43 can be easily assembled into its holding position and will not come out of that holding position without being subjected to certain removal procedures as will be described hereinafter. Generally, it can be said that the length d of the gap should be less than one-half of the radial height of the outer wall 44.

Considering now the assembly and disassembly of the retainer ring 43, the procedures are substantially the same except in reverse. We will therefore only describe the disassembly or removal process. Referring to FIG. 4, the U-clip 43 is shown in its assembled position as represented by the hatched outline. The first step in removal is to deflect the U-clip ring one end 49 radially inward to the point where the open end of the inner wall 46 just clears the annular flange 42. This position is shown in FIG. 5 and by the solid line, non-hatched, representation of the end of the ring as shown in FIG. 4. It should be noted that up to this point the ends 48 and 49 of the outer wall are in the same axial plane and thus interfere as shown in FIGS. 4 and 5 to prevent the one end 49 from being moved radially inward. The next step, now that the end of the inner wall 46 is clear of the annular flange 42, is to translate the ring end 49 axially outward, as indicated by the dotted line view of FIG. 4, until the two ends of the outer wall 44 clear as shown. At this point, the end 49 can be further moved radially inward such that the ends clear as shown in FIG. 7 and as shown by the solid line, non-hatched, view of the end 49 in FIG. 6. The ring can then be easily removed from the remaining portion of the annulus.

If the U-clip retainer ring 43 is constructed and applied as described hereinbelow, it provides a means for holding in the fixed assembly position the aft retainer/-seal 28 without the use of bolts or any other fasteners which tend to decrease the strength of the flanges and which tend to increase the complexity of assembly and disassembly. That is, the retainer ring 43 can easily be assembled by placing the ring, except for its one end, in its finally fixed position; putting the free end in the axially displaced position as shown by the dotted line in FIG. 4; translating that end axially inward until the ends 48 and 49 are mutually engaging and the free end of the inner wall 46 is clear of the annular flange 42; and, moving the end 49 radially outward into its fixed position. The retainer ring 43 will then remain in this fixed position, during all periods of engine operation or inoperation, until one subjects it to the removal procedures as described hereinabove.

In addition to the function of holding the aft retainer/seal 28 in position, the retainer ring 43 may be used for the purpose of holding together other components having axially abutting radially inward extending flanges. An alternate use of such a U-clip retainer ring 43 is shown in FIG. 8 wherein it is applied to secure a stationary compressor discharge pressure (CDP) seal 51 to a diffuser housing 52. This allows the seal 51 to be held in its position surrounding and engaging the rotatable portion 53 without the use of structure weakening, windage susceptible, bolt and hole combinations. Assembly and disassembly of the retainer ring 43 with respect to the mating flanges 54 and 56 is accomplished in a manner described hereinabove. It should be noted that the difference in radial depth of the outer and inner walls, and the length of the gap between the two ends may be varied so as to enable ease of assembly while ensuring a reliable holding function.

Referring now to FIGS. 9, 10 and 11, a modified embodiment of the U-clip arrangement is provided wherein the U-clip retainer ring 57 is constructed as shown in FIG. 9. The outer and inner walls 58 and 59, respectively, are preferably, but not necessarily, of substantially equal radial height. The inner wall 59 has a rather bulbous or thickened portion near its free end and an undercut portion 61 at the radially inner portion so as to allow for flexibility in installation and removal. Similarly, the outer wall 58 has a thickened portion near its free end and an undercut portion 62 near the radially inner portion thereof. The undercut portion 62 is large enough to receive, when the U-clip is in its fixed final position, a plurality of circumferentially spaced embossments 63 formed on the one face of the annular flange 39 as shown in FIGS. 9 and 11. Formed on the thicker portion of the outer wall 58 is an inner surface 64 which is relatively flat and which is adapted to fit tightly against the annular flange 39 to hold it in tight axial relationship with the annular flange 42. The circumferential length of this embodiment is preferably such as to provide a gap substantially as described above, but this length is not critical as in the previously described embodiment.

Installation of the U-clip retainer ring 57 is accomplished by the placing of the U-clip 57 just radially inward of the flanges 42 and 39, and forcing it radially outward to spring open and allow the outer wall 58 to slide over the embossments 63 and the inner wall 59 to tightly engage the one side of the annular flange 42. Installation is facilitated by beveled corners on both the inner and outer walls and on the edges of the flanges 39 and 42 as shown. Removal, of course, is accomplished by inserting a tool between the flange 39 and the outer wall 58 and springing the U-clip 57 apart to allow it to slide over the embossment 63.

Another means by which the U-clip may be secured in its fixed position is illustrated in FIGS. 12–15. Here the U-clip 66 is of a circumferential length such that when it is in place there is a substantial gap between the ends 67 and 68. The outer and inner walls 69 and 71, respectively, may be of equal radial height but are preferably of different radial height as shown to facilitate installation. A bridging element 72 is provided to be placed between the ends 67 and 68 in such a way as to also capture the flanges 39 and 42 between its outer and inner sides 73 and 74, respectively. As will be seen in FIGS. 13, 14 and 15, neither the outer side 73 nor the inner side 74 extends circumferentially in either direction as far as does the axially extending side 76. Thus, a pair of tabs 77 and 78 are formed as extensions to the axially extending side 76. These tabs act, when the bridging element 72 is in its fixed position, to radially hold the ends 67 and 68 of the U-clip in place by engaging the edges of the projections 79 and 81 of the inner wall 71. Radial retention of the bridging element 72 itself is provided by a flexible sheet metal clip 82 which fits axially between the outer side 73 and the annular flange 39 as shown in FIGS. 12–15. In order to accommodate and retain this sheet metal clip 82, a small groove 83 is formed in the one side of the annular flange 39 and a mating groove 84 is formed in the one face of the bridging element outer side 73 as shown. Assembly of the above-described embodiment is thus accomplished by first placing the U-clip in its finally assembled position; placing the bridging element 72 in its finally assembled position; sliding the sheet metal clip 82 into the gap between the bridging element outer side 73 and the annular flange 39; and, sliding the sheet metal clip 82 further into its final position in the grooves 83 and 84. Disassembly is accomplished by the reverse method.

A description of the damper/seal 24 portion of the invention will be best understood by reference to FIGS. 16–19. The damper/seal 24 comprises a segmented element which circumferentially abuts a similar damper/seal on either side thereof, with each blade having its own individual damper/seal 24. It comprises an inner dovetail portion 87, a central body portion 88 and the outer extending flange portion 26.

The dovetail portion 87 is inserted axially into the dovetail slot 13 of the disk 11 and is axially held in that position by the seal/damper retainer portion 36 of the aft retainer/seal 28 which lightly abuts its outer surface. In this way, retention by the dovetail slot holds the damper/seal 24 in its radial position and the aft retainer/seal 28 holds it in its axial position. Since both of these connections are substantially loose, the seal/damper 24 is somewhat free to pivot in the axial plane within the dovetail slot 89. This feature is important in allowing the seal/damper 24 to function in the desired manner.

The central body portion 88 of the seal/damper 24 extends radially and axially outward to terminate in the rearward extending flange 26. This flange has a forward face 91 which closely abuts the aft shank rail 22 to provide the desired damping/sealing function. It will be recognized that with the axially angled feature of the central body portion 88 and the rearward extension of the flange 26, the center of gravity of the damper/seal 24 is located outside, or to the right as seen in FIG. 16, of the pivot point of the damper. This pivot point will be located somewhere in the dovetail slot and will generally be substantially in the axial center of the dovetail portion 87. It should be recognized that the axial thickness of the dovetail portion 87 and the tightness within the dovetail slot should be limited to facilitate this pivoting in the axial plane.

In operation, when the disk 11 and damper/seal 24 are rotated, the centrifugal force acts at the center of gravity, C. G., and, since this is axially offset from the radial support point, the force tends to rotate the damper/seal 24 counterclockwise (as seen in FIG. 16) to thereby provide an axial force to the aft shank rail 22 of the blade 12 by way of the flange forward face 91. In this way, the magnitude of the damping force is proportional to the speed of the rotor, a characteristic which is desirable when considering the nature of blade vibrations.

In addition to providing a damping force which is independent of the clamping force maintained by the aft retainer 28, the above-described damper/seal arrangement: eliminates the thermally generated hoop stresses of prior damper arrangements; removes the outer portion of the aft retainer, which is sensitive to high temperature creep, from exposure to the high temperature gases; and, allows the damper/seal 24 which is exposed to the high temperature flow path 14 to be fabricated from high temperature resistant cast material. Further, the damper/seal 24 can be tuned to vary the damping force by shifting the mass and therefore the center of gravity thereof.

A further advantage of the above-described damper/-seal 24 can be seen by reference to FIG. 16 wherein the rearward extending flange 26 of the damper/seal 24 is closely disposed to the forward extending flange 92 of the associated stationary platform to jointly form a buffer seal between the hot gas path and the internal rotor cavity disposed radially inward thereof. This sealing combination complements that formed between the aft flange 37 and the stationary seal 93.

Figure 19:
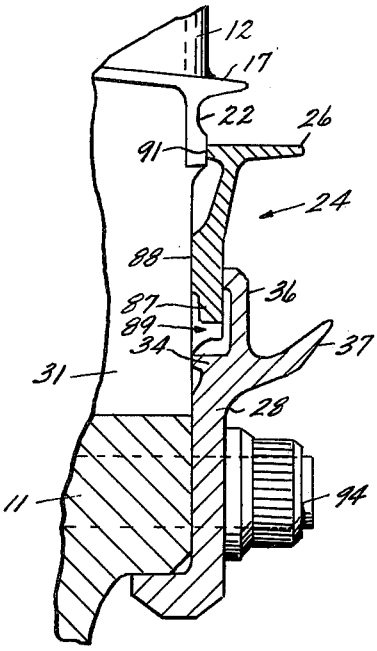
FIG. 19 is an axial cross-sectional view of the damper element as applied to a modified embodiment of the blade retainer apparatus.
Figure 18:
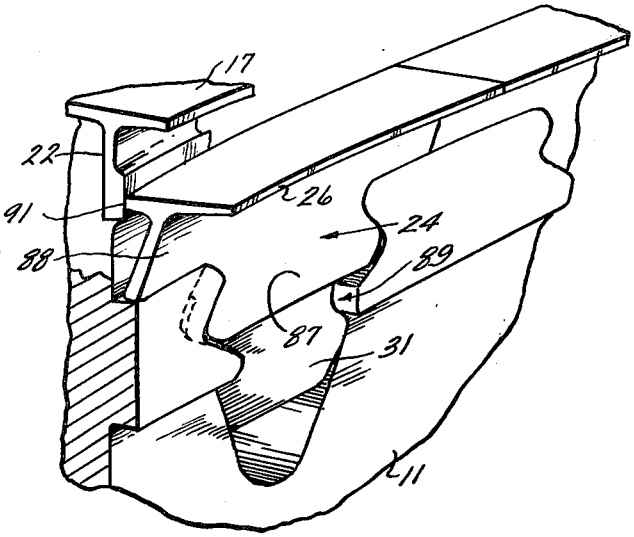
FIG. 18 is a perspective view of the damper and related portions thereof.

It should be recognized that the present damper/seal 24 can be used with retainer apparatus other than that described hereinabove. FIG. 19 shows such an alternative embodiment wherein the damper/seal 24 is held in place by an aft retainer 28 in the same manner as described hereinabove, but the aft retainer/seal 28 is secured by a plurality of fasteners or bolts and nuts 94. Although these bolt attachments are undesirable for the reasons discussed hereinabove, the damper/seal 24 will operate satisfactorily and independent of this attachment.

It will be understood that the present invention has been described in terms of particular embodiments, but may take on any number of other forms while remaining within the scope and intent of the invention. For example, it will be recognized that the present invention has been described in terms of use with a turbine blade or blades but could as well be applied to compressor or fan blades.

Having thus described the invention, what is claimed as novel and desired to be secured by Letters Patent of the United States is:

1. An improved blade retention apparatus for use with a disk having blades inserted in axial dovetail slots wherein the improvement comprises:

(a) flange means extending from said disk in a radially inward direction;

(b) a retainer element having a coupling portion which closely engages one axial side of said flange means and having an axial load portion which extends radially outward to retain the blade in the axial direction;

(c) a split retainer ring having a U-shaped cross section with its open side disposed radially outward for receiving in close-fit relationship said flange means and said retainer element coupling portion to hold them axially together; and (d) means for maintaining said retainer ring in its holding position.

2. An improved blade retention apparatus as set forth in claim 1 wherein said flange means is circumferentially continuous.

3. An improved blade retention apparatus as set forth in claim 1 wherein said retainer element comprises a continuous ring.

4. An improved blade retention apparatus as set forth in claim 1 wherein said blade retainer element coupling portion engages said flange means on the side away from said disk.

5. An improved blade retention apparatus as set forth in claim 1 wherein said axial load portion engages a damper element to thereby bias against said blade.

6. An improved blade retention apparatus as set forth in claim 1 wherein said split retainer ring includes radially extending inner and outer walls, said inner wall having a smaller radial height than said outer wall to facilitate installation of said retainer ring into a holding position with said inner wall nearest said disk, and the circumferential length of said split retainer ring in such that no other means is required for maintaining said retainer ring in its holding position.

7. An improved blade retention apparatus as set forth in claim 6 wherein the difference between the radial heights of said outer and inner walls is less than one-half the radial height of said outer wall.

8. An improved blade retention apparatus as set forth in claim 6 wherein the difference between the radial heights of said outer and inner walls is greater than one-fourth the radial height of said outer wall.

9. An improved blade retention apparatus as set forth in claim 6 wherein the circumferential length of said split retainer ring is such that when it is placed in the holding position a gap exists between its two ends, the length of said gap being less than one-half the radial height of said outer wall.

10. An improved blade retention apparatus as set forth in claim 6 wherein the difference between said outer and inner wall radial heights, and the circumferential length of said retainer ring are so sized that when said retainer ring is placed in the holding position, it may not be readily removed therefrom while the ends of said ring remain in the plane of said ring but may be readily removed if one of the ends is moved into a helical plane at an angle to the plane of said ring.

11. An improved blade retention apparatus as set forth in claim 1 wherein said means for maintaining said retainer ring in its holding position comprises embossment means on said retainer element coupling portion such that said split ring retainer ring can be snapped over said embossment means and be retained in a holding position by said embossment means.

12. An improved blade retention apparatus as set forth in claim 11 wherein said embossment means comprises a plurality of circumferentially spaced embossments.

13. An improved blade retention apparatus as set forth in claim 1 wherein said means for maintaining said retainer ring comprises a bridging element placed between the ends of the retainer ring for radially retaining said ends and means for radially retaining said bridging element in its holding position.

14. An improved blade retention apparatus as set forth in claim 13 wherein said bridging element has wall elements which axially overlap adjacent wall elements of the retainer ring.

15. An improved blade retention apparatus as set forth in claim 13 wherein said means for axially retaining said bridging element comprises a clip removably disposable in opposing circumferential grooves of said retainer element and said bridging element.

* * * * *